United States Patent [19]

Bessette

[11] 4,323,190

[45] Apr. 6, 1982

[54] CENTRIFUGE BOWL END ATTACHMENT FLANGES

[75] Inventor: Norman F. Bessette, Somerset, Mass.

[73] Assignee: Bird Machine Company, Inc., South Walpole, Mass.

[21] Appl. No.: 152,043

[22] Filed: May 21, 1980

[51] Int. Cl.[3] ..... B04B 11/00; B04B 7/08

[52] U.S. Cl. ..... 233/46; 233/7

[58] Field of Search ..... 233/46, 47 R, 7, 8, 233/9, 6, 3, 27, 19 A; 198/673; 366/220, 233

[56] References Cited

U.S. PATENT DOCUMENTS

| | | | |
|---|---|---|---|
| 3,764,062 | 10/1973 | Broutigam | 233/7 |
| 3,795,361 | 3/1974 | Lee | 233/7 |
| 3,937,317 | 2/1976 | Fleury | 233/7 |
| 4,006,855 | 2/1977 | Merzenich | 233/7 |
| 4,190,194 | 2/1980 | Amero | 233/7 |

OTHER PUBLICATIONS

Public Use and/or Sale in the U.S. prior to May 21, 1979 of Centrifuge Head Solids End per Bird Machine Company Drawing ZLB5-182-00960, 11-4-75.

Public Use and/or Sale in the U.S. prior to May 21, 1979 of Centrifuge Head Solids end per Bird Machine Company Drawing ZLB5-182-01140, 6-10-76.

*Primary Examiner*—Robert W. Jenkins

*Attorney, Agent, or Firm*—Edgar H. Kent

[57] ABSTRACT

A rotary centrifuge has a bowl and an end member provided with mutually attachable flanges at least one of which has a series of plugs secured in transverse cavities near its periphery with a portion of the plugs less than their full width protruding from the flange periphery through slots communicating with the cavities at regular intervals spaced peripherally less than 15 inches between slot center lines. At least the protruding plug portions have a resistance to abrasive wear approximately equal to or greater than that of 90% aluminum oxide ceramic.

11 Claims, 9 Drawing Figures

FIG 4
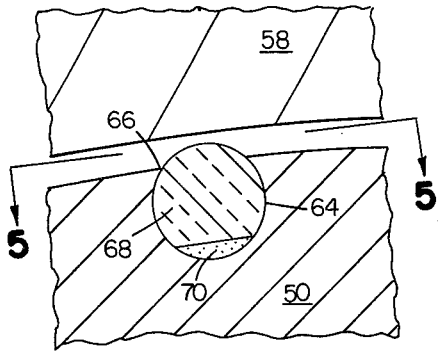
FIG 5
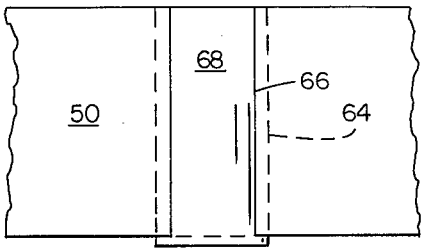
FIG 6
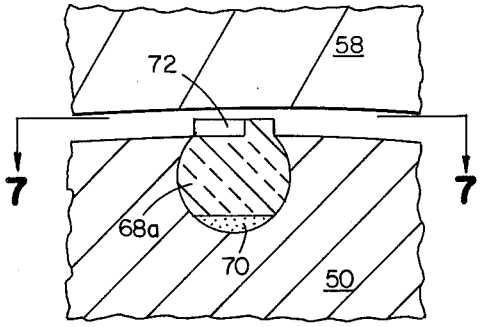
FIG 7
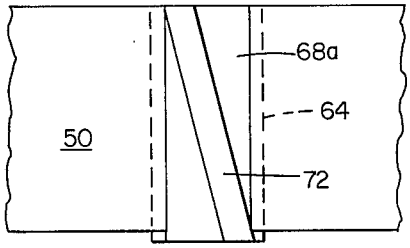
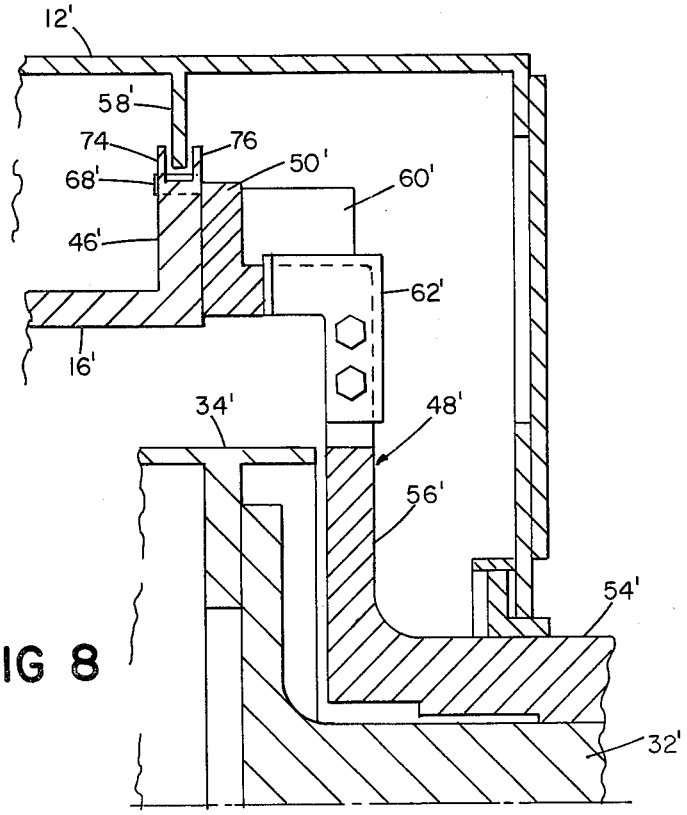
FIG 8
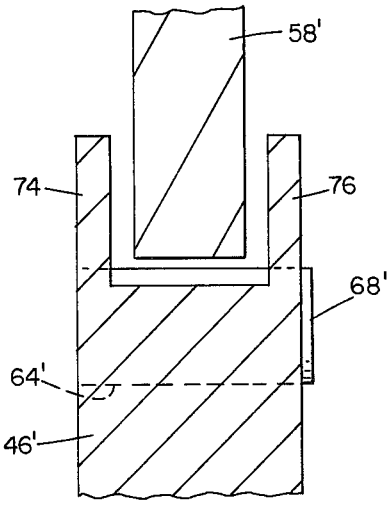
FIG 9

CENTRIFUGE BOWL END ATTACHMENT FLANGES

BACKGROUND OF THE INVENTION

1. Field of the Invention

This invention relates to centrifuge bowl end closure attachment flanges, particularly such flanges located at the solids discharge end of the bowl of a solids-liquid separating centrifuge of the continuous solids discharging type.

2. Description of the Prior Art

Centrifuges of the type concerned commonly have a generally cylindrical bowl rotated at high speed about its axis to separate the solids toward the bowl by centrifugal force of a solids-liquid slurry continuously fed thereto; a conveyor helix rotated in the same direction at a slightly different speed to move the solids continuously to and out a frusto-conical end outlet from the bowl; and ports in the opposite bowl end, or internal scoops within the bowl for continuously discharging the separated liquid fraction. The bowl is provided with end members or "heads" which are usually provided with an annular radial flange bolted to a similar flange on the bowl to join the parts together. A stationary casing enclosure for the centrifuge has an annular baffle closely surrounding at least one of the joined flanges at the solids discharge end of the centrifuge to form an end compartment in the casing for receiving the discharged solids.

Such centrifuges are commonly applied to the treatment of slurries containing highly abrasive solids, as when used for dewatering coal. Despite the use of rotary plows in the solids receiving compartment of the centrifuge, these abrasive solids tend to accumulate at the compartment side of the casing baffle and between the baffle and the joined bowl flanges. Even though the flanges, like the bowl, are formed of metal (e.g., stainless steel) that is long wearing under normal circumstances, the so accumulated hard abrasive particles, pressing on the flanges rotating at high speed, wear awaythe flanges so rapidly that frequent repair or replacement is necessary. The cost of such frequent repair or replacement, added to the cost of centrifuge downtime necessary to accomplish it, in many cases is a major item of the expense of the centrifuge operation of the plant.

Known prior art efforts to solve the problem have not had satisfactory results. Generally these have involved welding hard wear-resistant material to the outer end surface of the flange, generally in the form of ribs of height just clearing the casing baffle. In one such arrangement, the ribs were located at frequent intervals transversely across the flange end and were angled to act as an air pump. However, it has been generally found that welded-on wear-resistant materials do not add greatly to wear life, having inherent susceptibility to fracture under load and insufficient resistance to the concentrated wear forces involved.

SUMMARY OF THE INVENTION

The object of the invention is to provide end member attachment flanges of the end member and/or centrifuge bowl which are more effectively protected against abrasive wear when used under the conditions mentioned than has heretofore been possible.

In attaining this objective, the invention utilizes plugs of hard, long wearing material which are partially housed in cavities formed in the body of the flange, extending transversely through the flange at suitable intervals about its periphery. The cavities are formed to provide a slot opening thereto in the periphery of the flange, extending transversely across it, through which a portion of a plug secured in the cavity projects to an extent sufficient to provide a raised land on the flange periphery, having its maximum radius slightly less than that of the inner periphery of the casing baffle to provide clearance when the baffle is to overlie the flange. The projection of the plugs through the peripheral slots of the flange is less than the width of the plug, so that the portion of the plugs within the cavities cannot be dislodged through the slot.

Close regular spacing of the protruding plug portions circumferentially of the flange is important. Such spacing should not exceed 15 inches (375 m.m.) along the flange perimeter, and is preferably about 8 to 10 inches (200 to 250 m.m.). The hardness and abrasive resistance of the protruding plug portions, obviously also important, should be greater than that of the flange and at least approximately equal to that of ceramic containing 90% of aluminum oxide.

Accordingly, the invention provides the combination of a rotary centrifuge bowl having a radially projecting flange and a bowl end member having a radially projecting flange for attachment to the bowl flange. At least the one of these flanges most closely associated with a case baffle is provided with cavities containing plugs of hard wearing material partially protruding from the flange periphery, constructed and arranged as just described. Such flanges have been found to withstand abrasive wear far better and longer than flanges provided with welded beads of the prior art when exposed to like abrasive wear conditions.

DESCRIPTION OF THE DRAWINGS

In the drawings:

FIG. 4 is a fragmentary vertical cross-section view of a casing baffle and of a flange constructed in accordance with the invention;

FIG. 5 is a plan view taken on line 5—5 of FIG. 4, looking in the direction of the arrows;

FIG. 6 and 7 are views respectively like those of FIGS. 4 and 5, showing a modified flange structure;

FIG. 8 is a fragmentary vertical cross-section of the solids discharge end of a centrifuge and case assembly, similar to FIG. 1, showing another flange modification; and FIG. 9 is an enlargement of a portion of FIG. 8.

DESCRIPTION OF THE PREFERRED EMBODIMENTS

Figure 1:
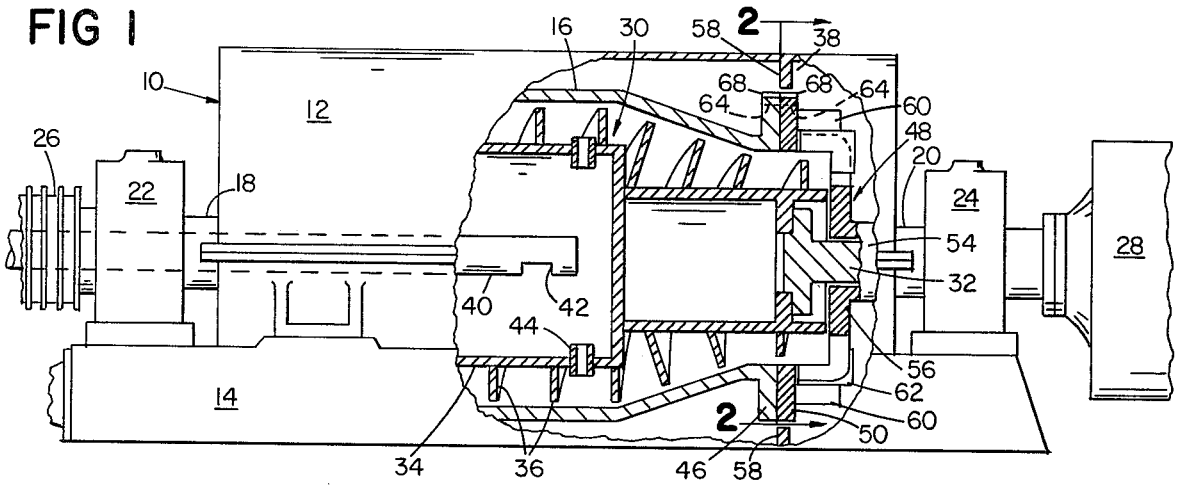
FIG. 1 is a side elevation view of a continuous centrifuge and case, broken away to show interior structure in cross-section at the solids discharge end of the bowl, including the flanges to which the invention is applied.

FIG. 1 shows a complete assembled centrifuge of a conventional continuous solids discharge type here concerned, with the solids discharge end exposed to show the parts to which the invention is applied.

In FIG. 1, the centrifuge, designated generally 10, has a casing 12 mounted on a base 14. Within the casing, the centrifuge bowl 16 is rotatably monted by means of hollow end shafts 18, 20 extending through bearing pedestals 22, 24 respectively. Shaft 18 has a drive pulley 26 fixed to its outer end from which the bowl is rotated by drive belts from a motor (not shown). Shaft 20 is fixed to the casing 28 of a gear box which rotates with the shaft 20 and contains speed change gearing (not shown) which may be of the conventional planetary type.

A conveyor designated generally 30 is coaxially mounted within the bowl 16 by means of end shafts of which the right-hand shaft 32 only is shown, these end shafts being mounted in bearings (not shown) in shafts 18 and 20. Shaft 32 is connected to the speed change gearing in casing 28 so that it is rotated through the gearing in the same direction as the bowl but at a slightly different speed. Conveyor 30 has a hollow hub 34 on which helical conveyor blade 36 is mounted, this blade conveying the solids settling in the bowl from left to right in FIG. 1 and discharges them from the right-hand end of the bowl in that Figure into a receiving compartment 38 in casing 12. The liquid discharge arrangement (not shown) may be through ports located in the left-hand end of the bowl in FIG. 1 into a receiving compartment at that end of casing 12. A feed pipe 40 for solids-liquid slurry extends through the hollow core of the left end conveyor shaft into a feed compartment in conveyor hub 34, to which it discharges the feed from an outlet 42, the feed in turn discharging to the bowl 16 via ports 44 in hub 34.

Figure 2:
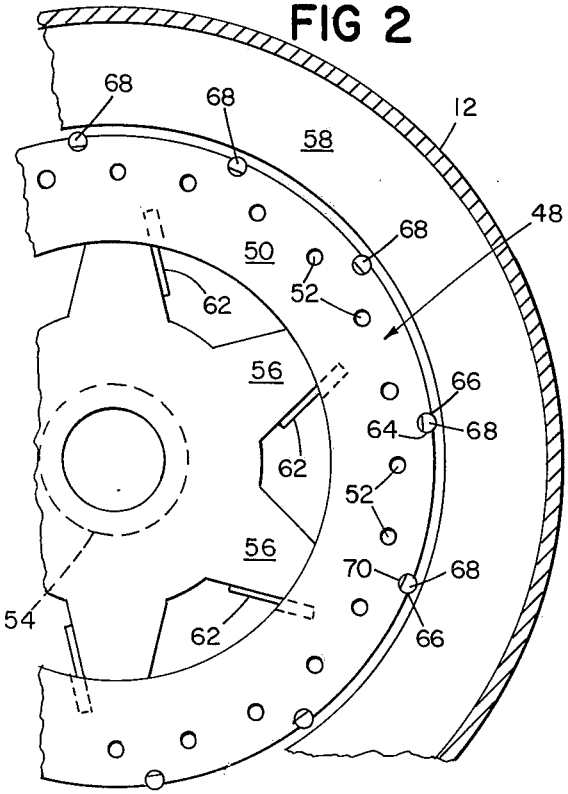
FIG. 2 is an enlarged elevation view, broken away in part, taken on the line 2—2 of FIG. 1, looking in the direction of the arrows, with structure internal of the centrifuge bowl omitted.
Figure 3:
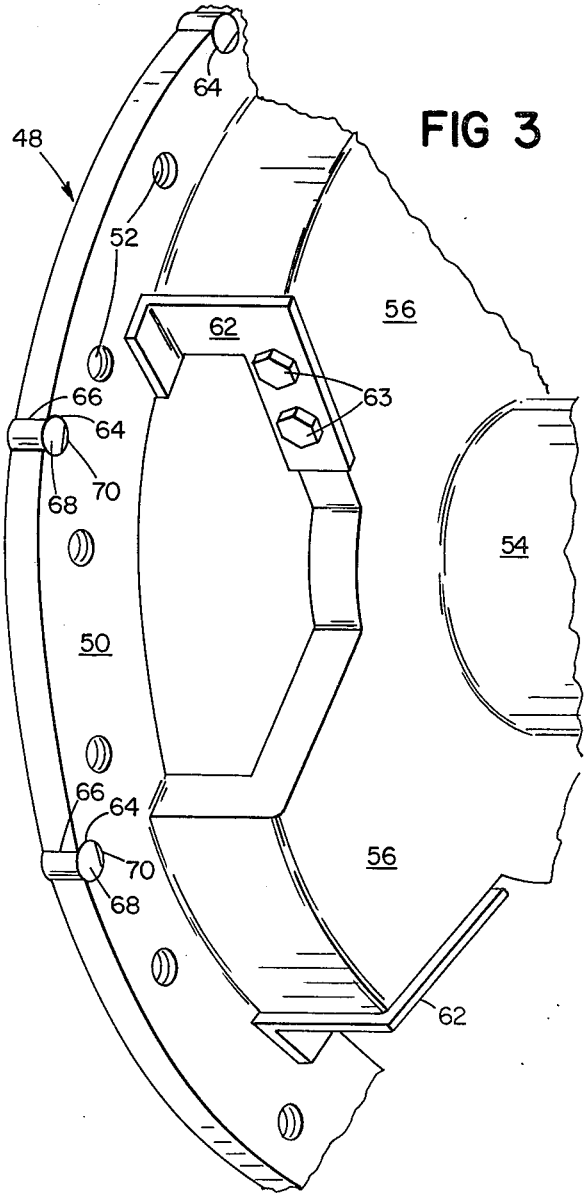
FIG. 3 is a fragmentary perspective view from the opposite side of the member shown in FIG. 2.

Centrifuge bowl 16 is frusto-conically tapered at its solids discharge end and has a radially projecting flange 46 at its smaller end. A bowl end member designated generally 48 has a radially projecting flange 50 which is secured to bowl flange 46 by bolts (not shown) passed through apertures 52 in flange 50 (FIGS. 2 and 3) and through registering apertures (not shown) in flange 46. As shown in FIGS. 2 and 3, end member 50 is formed as a spider, the hub 54 of which is integral with bowl shaft 20 and the arms or spokes 56 of which are integral with flange 50. The spaces between the spokes 56 form ports through which the solids conveyed to the end of the bowl discharge into casing compartment 38, the inner periphery of flange 50 being flush with the inner end surface of the bowl. A baffle 58 on the inner wall of casing 12 has an annular inner edge opposite the peripheries of joined flanges 46 and 50, in this instance immediately opposite the periphery of flange 50.

Casing baffle 58 and bowl end member 48 form a sidewall of casing compartment 38 which is closed except for the clearance between baffle 58 and flange 50 and the discharge openings between spokes 56 of member 48. Compartment 38 is swept by case plows 60 secured to spokes 56 and rotating with the bowl. Plows 62 of hard wearing material are secured by bolts 63 to the side edge of each spoke 56 which faces in the direction of rotation, this being clockwise in FIG. 1 when viewed in the direction of the arrows of line 2—2. Casing plows 60 clear the solids to a bottom discharge chute (not shown) in compartment 38, while plows 62 provide wear protection for spokes 56.

So far, the structure described is conventional. When the centrifuge is processing material containing hard abrasive particles such as coal slurry, abrasive particles discharged into compartment 38 tend to accumulate between the casing and the peripheries of the flanges of the bowl and of the bowl end member, particularly between the casing baffle 58 and the flange with which it is most closely associated, rapidly wearing away the steel of the relatively rotating flange peripheries and necessitating frequent repair or replacement. To minimize such wear and greatly extend the flange life, the invention alters the structure of at least that one of the flanges which is most closely associated with the baffle, as now to be described. In FIG. 1 both flanges 46 and 50 are altered in identical manner, the altered structure of flange 50, which is most closely associated with baffle 58, being more particularly illustrated and described, this being deemed sufficient due to the identity.

Referring to FIGS. 1–5, each flange 46 and 50 is provided with cavities 64 which extend the full width of the flange and through its periphery to provide a slot 66 across the peripheral end surface of the flange, the slot being of lesser width than the maximum width of the cavity. In each cavity is located a plug 68 of hard wear-resistant material, secured therein by adhesive indicated at 70, which may suitably be an epoxy adhesive. The plugs are sized relative to the cavities such that a portion thereof projects through slot 66 to form a raised land on the peripheral end surface of the flange. As seen in FIG. 5, plugs 68 are slightly longer than the thickness of the flange and are secured in the cavities with one end flush with the joined side of the flange and the other end protruding slightly from the opposite side of the flange. The cavities are shown as cylindrical, a form which permits convenient formation by drilling, and the plugs 68 shown in FIGS. 1–5 are also of a closely fitting cylindrical shape with a slight flat to facilitate attachment by adhesive. Cavities of other cross-sectional shapes would function adequately but are more difficult to produce. The projection of the plug beyond the peripheral surface of the flange at its maximum need not be large and may be on the order of ⅛th inch (3.2 m.m.). As shown, the projection is less than half the radius of the plug. In the case of flange 50, the plug projections have close clearance with baffle 58.

In assembling the plugs in the cavities, they and the cavity walls are first coated with the adhesive. The plugs are then tapped endwise into the slots, the plugs being positioned as shown in the drawings. The slight flat on the radially innermost portion of the plugs provides a channel between plug and cavity in which adhesive can collect and out the ends of which excess adhesive can discharge.

As stated earlier herein, the plugs 68 are made, at least in the projecting portion, of extremely hard and longwearing material. Plugs made of ceramic of 90% aluminum oxide content (Rockwell A hardness 87.5) have been found to provide far longer flange life under extreme abrasive wear conditions than welded beads of the prior art; whereas, ceramic plugs of 85% aluminum oxide (Rockwell A hardness 84.5) showed no significant improvement in wear protection of the flange over the welded beads, although the plugs were spaced apart somewhat more than the maximum hereafter specified, which may have contributed to the unsatisfactory performance. The invention therefore utilizes plugs of an abrasive wear resistance in the projecting portion at least equal to that of about 90% aluminum oxide ceramic and the plugs are preferably molded entirely of ceramic of 90% or higher aluminum oxide content. Ceramic of the specified aluminum oxide content is commercially available under the designation "AD90" for plugs molded to order from Coor's Porcelain Co. of 600 Ninth Street, Golden, Colo. 80401. Other commercially available materials of similar hardness and abrasive wear characteristics include 99.5% aluminum oxide ceramic (Coors "AD995"), tungsten carbide (94–6), and boron carbide, although in abrasive wear tests by sand and by silicon carbide these materials were somewhat inferior to Coor's "AD90".

Proper circumferential spacing of the plug projections is another important factor. As previously stated, it should be regular and not exceed 15 inches (375 m.m. between the center lines of the slots). Currently 12 of the plugs are used in flanges 39 inches (975 m.m.) in diameter for a circumferential spacing of about 10 inches (250 m.m.), about 8 to 10 inches (200 to 250 m.m.) being preferred.

FIGS. 6 and 7 show a modified form of plug, designated 68*a*, in that the portion projecting through slot 66 is formed as an axial rib 72 which is at an angle to the plug and slot axis, about 15° as illustrated. Since the cavities and plugs are shown with their axes parallel to the axis of rotation of the flange, the ribs are at an angle to a vertical plane containing the axis of rotation of the flange. Such ribs therefore act as fan blades to provide a directed air flow away from the rib end foremost in the direction of rotation of the flange. Such modified plugs may be used in one, some or all of the cavities in one or both flanges to provide an air flow across the flange end in whichever of two opposite directions is desired. As shown in FIGS. 6 and 7, where the direction of rotation is assumed to be from left to right or clockwise, the air flow induced by ribs 72 would be away from compartment 38, thus tending to hinder passage in the opposite direction of liquid between the flanges and the baffle 58.

FIGS. 8 and 9 show a modified bowl end assembly, in which parts corresponding to those in FIGS. 1–5 are designated with primes of the same reference numerals. The principal modification is the provision on the bowl end flange 46' of annular extensions 74, 76 of the flange rims, which form between them a trough in which the edge of casing baffle 58' is received with close clearance from the intermediate portion of the flange. There is thus formed a labyrinth seal, construction which is used, for example, in so-called "screenbowl" centrifuges in which the bowl is perforate near its discharge end. Since the portion of the casing to the left of baffle 58' in FIG. 7 is a receiver of liquid discharged through the perforate portion of the bowl, it is important to provide the extra safeguard of the seal against escape of liquid splashing from the liquid receiver to the solids receiving compartment at the other side of the baffle. The cavities 64' and the plugs 68' (shaped as in FIGS. 1–5 in this instance) are as previously described, except that they are provided only in bowl flange 46' and their ends form apertures instead of slots, the top of which lies in respective flange rim extensions 74, 76.

Locating the cavities and plugs with their axes parallel to the axis of rotation of the flange as shown is convenient for drilling the cavities and molding the plugs. They may however be located with their axes at an angle to the vertical plane containing the axis of rotation of the flange, in which case rib 72 (FIGS. 6 and 7) may be parallel to the plug axis.

I claim:

1. The combination of a rotary centrifuge bowl having an end with a radially projecting flange and a bowl end member having a radially projecting flange for attachment to said bowl flange, at least one of said flanges comprising:

a series of regularly spaced cavities extending transversely therethrough near the periphery thereof, each said cavity opening through the flange periphery to provide a slot of lesser width than the cavity extending transversely across said flange periphery, the peripheral spacing of the center lines of said slots being less than 15 inches; and a series of plugs secured in said cavities with a portion thereof protruding through the said cavity slot to project above the flange periphery, said portion being of lesser width than the remainder of said plug and having abrasive wear resistance at least approximately equal to that of 90% aluminum oxide ceramic.

2. The combination according to claim 1 wherein said cavities have their axes substantially parallel to the axis of rotation of the flange.

3. The combination according to claim 1 wherein said plugs are formed of ceramic containing at least about 90% aluminum oxide.

4. The combination according to claim 1 wherein said cavities and plugs are generally cylindrical.

5. The combination according to claim 1 wherein said peripheral spacing is about 8 to 10 inches.

6. The combination according to claim 1 wherein said plugs are adhesively secured in said cavities.

7. The combination according to any of claims 1–6 wherein said protruding portion of at least one of said plugs is of substantially rectangular cross-section and is arranged with its longitudinal axis at an angle to a vertical plane containing the axis of rotation of the flange.

8. The combination according to claim 7 wherein said cavities and plugs have their axes substantially parallel to the axis of rotation of the flange and said protruding portion is arranged with its axis at an angle to the axes of the plugs and cavities.

9. The combination according to any of claims 1 to 6 which includes a casing for said bowl and said bowl end member when assembled and mounted for rotation about the bowl axis, said casing having an annular baffle arranged to surround a said one of said flanges with close clearance from the protruding portions of said plugs therein, said baffle, flange and end member forming a wall of a collecting compartment for solids discharged from said bowl end.

10. The combination according to claim 9 wherein said one of said flanges is provided at its peripheral edges with radial extensions forming an open trough for receiving said baffle between them; said slots and protruding plug portions lying between said extensions, said baffle having close clearance from the protruding plug portions exposed between said extensions.

11. The combination according to claim 1 wherein said flanges are provided with mating apertures therethrough for the reception of bolts to fasten the flanges together.

* * * * *